US008127685B2

(12) United States Patent
O'Dwyer et al.

(10) Patent No.: US 8,127,685 B2
(45) Date of Patent: Mar. 6, 2012

(54) MODIFICATION OF A PROJECTILE FOR STACKING IN A BARREL

(75) Inventors: James Michael O'Dwyer, Brisbane (AU); Sean Patrick O'Dwyer, Brisbane (AU)

(73) Assignee: Metal Storm Limited, Queensland (AU)

( * ) Notice: Subject to any disclaimer, the term of this patent is extended or adjusted under 35 U.S.C. 154(b) by 0 days.

(21) Appl. No.: 10/556,957

(22) PCT Filed: May 13, 2004

(86) PCT No.: PCT/AU2004/000632

§ 371 (c)(1), (2), (4) Date: Oct. 30, 2006

(87) PCT Pub. No.: WO2004/102108

PCT Pub. Date: Nov. 25, 2004

(65) Prior Publication Data

US 2007/0056460 A1 Mar. 15, 2007

(30) Foreign Application Priority Data

May 13, 2003 (AU) ..... 2003902297

(51) Int. Cl.
*F42B 12/58* (2006.01)

(52) U.S. Cl. ..... 102/438

(58) Field of Classification Search ..... 102/501, 102/524–528, 438

See application file for complete search history.

(56) References Cited

U.S. PATENT DOCUMENTS

| | | | | | |
|---|---|---|---|---|---|
| 694,896 | A | * | 3/1902 | Scott | 102/438 |
| 1,376,530 | A | * | 5/1921 | Greener | 102/438 |
| 2,083,665 | A | * | 6/1937 | Pihl et al. | 102/431 |
| 2,313,030 | A | * | 3/1943 | Tauschek | 89/135 |
| 2,450,910 | A | * | 10/1948 | O'Rear | 102/393 |

(Continued)

FOREIGN PATENT DOCUMENTS

DE 2752844 A 8/1982

(Continued)

OTHER PUBLICATIONS

Metal Storm Limited, International Search Report, PCT/AU2004/000632, Jul. 16, 2004, 5pp.

*Primary Examiner* — Troy Chambers
(74) *Attorney, Agent, or Firm* — SNR Denton US LLP

(57) ABSTRACT

An existing projectile (21) is modified by adding a tail piece (22) to enable axial stacking of multiple projectiles (20) in a common barrel. Propellant for each modified projectile (20) is contained in respective chambers located external to the barrel and connected to the bore of the barrel through associated ports. Tail piece (22) aligns with a respective port and provides a space between consecutive projectiles (20) into which the propellant gas expands after ignition. Separate claims are directed to tail assembly (22), modified projectile (20), the barrel assembly having a plurality of projectiles (20) stacked in end-to-end relation, and to an external initiation system for the barrel assembly (see FIGS. 4, 7).

11 Claims, 8 Drawing Sheets

U.S. PATENT DOCUMENTS

| | | | | | |
|---|---|---|---|---|---|
| 2,786,415 | A | * | 3/1957 | Alderson | 102/445 |
| 2,938,430 | A | | 5/1960 | Pion | |
| 3,139,795 | A | | 7/1964 | Altschuler | |
| 3,169,333 | A | * | 2/1965 | Scanlon, Jr. | 42/69.01 |
| 3,181,465 | A | * | 5/1965 | Anthony | 102/445 |
| 3,412,681 | A | * | 11/1968 | Schirneker | 102/438 |
| 3,421,244 | A | | 1/1969 | Reed | |
| 3,808,941 | A | | 5/1974 | Biggs | |
| 3,815,271 | A | | 6/1974 | Lynn | |
| 3,877,381 | A | * | 4/1975 | McCoy | 102/501 |
| 3,952,658 | A | * | 4/1976 | Broyles | 102/438 |
| 4,012,985 | A | | 3/1977 | Magnusson | |
| 4,026,188 | A | | 5/1977 | Woodruff et al. | |
| 4,621,579 | A | | 11/1986 | Badura et al. | |
| 4,709,615 | A | * | 12/1987 | Field | 89/1.56 |
| 4,938,146 | A | * | 7/1990 | Gunther et al. | 102/439 |
| 5,042,388 | A | | 8/1991 | Warren et al. | |
| 5,259,319 | A | * | 11/1993 | Dravecky et al. | 102/447 |
| 5,492,064 | A | * | 2/1996 | Boutet | 102/520 |
| 5,834,684 | A | * | 11/1998 | Taylor | 102/517 |
| 5,936,189 | A | * | 8/1999 | Lubbers | 102/439 |
| 6,123,007 | A | * | 9/2000 | O'Dwyer | 89/135 |
| 6,186,072 | B1 | * | 2/2001 | Hickerson et al. | 102/518 |
| 6,223,642 | B1 | * | 5/2001 | O'Dwyer | 89/7 |
| 6,301,819 | B1 | * | 10/2001 | O'Dwyer | 42/84 |
| 6,343,553 | B1 | * | 2/2002 | O'Dwyer | 102/438 |
| 6,431,076 | B1 | * | 8/2002 | O'Dwyer | 102/525 |
| 6,453,821 | B1 | * | 9/2002 | Fowler et al. | 102/527 |
| 6,510,643 | B2 | * | 1/2003 | O'Dwyer | 42/84 |
| 6,588,700 | B2 | * | 7/2003 | Moore et al. | 244/3.28 |
| 6,862,996 | B2 | * | 3/2005 | Key | 102/517 |
| 7,194,943 | B2 | * | 3/2007 | O'Dwyer | 89/28.05 |
| 7,373,884 | B2 | | 5/2008 | Haeselich | |
| 7,475,635 | B2 | * | 1/2009 | Bambach | 102/438 |
| 2002/0178960 | A1 | * | 12/2002 | Ramaswamy | 102/439 |
| 2005/0246934 | A1 | * | 11/2005 | O'Dwyer | 42/84 |
| 2005/0268807 | A1 | * | 12/2005 | Bambach | 102/438 |

FOREIGN PATENT DOCUMENTS

| | | | |
|---|---|---|---|
| GB | 124801 | | 4/1919 |
| GB | 1534134 | A | 11/1978 |
| WO | WO 00/62005 | A | 10/2000 |

* cited by examiner

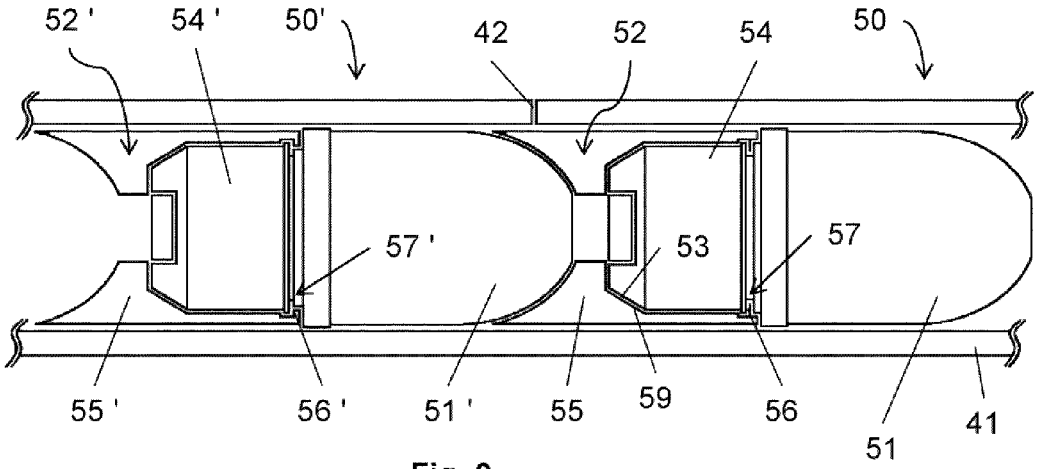
Fig. 9
Fig. 10
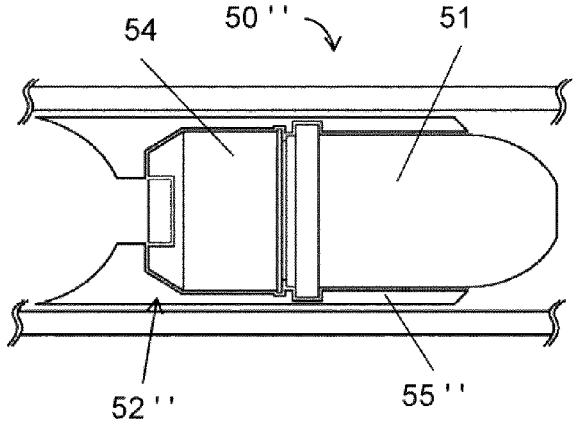
Fig. 11
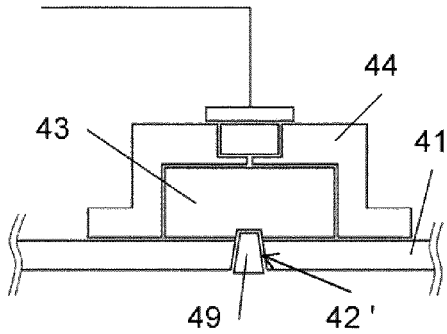

MODIFICATION OF A PROJECTILE FOR STACKING IN A BARREL

CROSS REFERENCES TO RELATED APPLICATIONS

The present patent application is a national phase application of International Application No. PCT/AU2004/000632 filed May 13, 2004, which claims priority from Australian Application No. 2003902297 filed May 13, 2003.

FIELD OF THE INVENTION

This invention relates to modification of existing projectile designs in order to adapt them for use with similar projectiles stacked together within a barrel. The invention also relates to initiation of propellant charges for projectiles, particularly to external initiation arrangements for projectiles suited to axial stacking within a barrel.

BACKGROUND OF THE INVENTION

Considerable time and effort is usually required in order to qualify new projectile or ammunition designs for commercial sale and use, according to the applicable regulatory requirements. These requirements are particularly stringent for man-portable or hand held weapons, such as grenade launchers. Accordingly, it is considered desirable and cost-effective to modify existing projectile designs for use stacked together within a barrel, such as envisaged in the present applicant's earlier International Patent Application No. PCT/AU00/00297.

One type of projectile of interest is a tube launched grenade, such as 40 mm or similar calibre, which are usually launched from relatively thin-walled barrels used in man portable launchers. There is shown in FIG. 1, one example of prior art tube-launched 40 mm grenade.

The grenade 10 includes two main parts, a projectile body 11 and a cartridge case 12. The projectile body 11 has a rounded nose portion 13 that typically contains a payload, such as high explosive of pyrotechnic matter, together with a fusing system. The cartridge case 12 is attached to a rear portion 14 of the projectile body and encloses a two-stage burner 15 for launching the grenade projectile 10 from a tube.

Typically the cartridge case 12 is conveniently removable from the projectile body 11, as depicted in FIG. 2. The rear portion 14 of the projectile body 11 includes an axially extending recess 16 which may have an internal screw-thread for attaching to the projectile body 11 a container for a tracer compound.

SUMMARY OF THE INVENTION

The applicant proposes a method of modifying existing qualified projectiles in order to contain costs whilst providing enhanced functionality, including facilitating the sequential firing of multiple projectiles from a single barrel, especially thin-walled barrels typical of grenade launchers.

In one broad aspect, the invention resides in a tail assembly for a projectile to enable use with similar projectiles axially stacked in end-to-end relation within a barrel, said tail assembly including: attachment means for attaching the tail assembly to a body of the projectile; a spacer arranged for abutment by a nose portion of a following projectile and providing an expansion space rearwardly of the projectile body; said spacer configured to allow fluid communication between said expansion space and at least one port provided in the barrel wall; whereby, upon ignition of the propellant charge, combustion products are communicated into the expansion space through said at least one port to propel the projectile from said barrel.

In a still further broad aspect, the invention resides in a barrel assembly having a plurality of projectiles stacked in end-to-end relation with a barrel, said barrel assembly including: a plurality of discrete propellant charges arranged externally of the barrel for propelling respective projectiles sequentially from the barrel; a series of igniters for initiating combustion of the discrete propellant charges; the projectiles each having a tail assembly with attachment means for attaching a spacer to a body of said projectile, which spacer is arranged for abutment by a nose portion of a following projectile to provide an expansion space within the barrel and rearwardly of the projectile body; the barrel including a plurality of ports in a wall of the barrel, each port allowing fluid communication between a propellant charge and the interior of the barrel; said spacer configured to allow fluid communication between at least one port in an adjacent wall of the barrel and said expansion space.

If required the plurality of projectiles are retained together by frangible couplings. The frangible couplings may comprise a solder joint between each spacer body and an abutting nose portion of the following projectile, or respective spigot and socket members provided on the nose or tail portions of the projectile bodies.

Preferably, each expansion space includes sealing means for controlling undesirable spread of propellant combustion products within the barrel.

In one form the sealing means include a sealing device provided on the tail assembly of the projectile. The sealing device may be selected from a resilient obturation ring, a spacer having a wedging surface for cooperation with a complementary wedging surface on the projectile body and/or a sealing band carried by the projectile body. The sealing band may be retained on the projectile body adjacent a wedging surface by the spacer.

In an alternative form, the sealing means include plug members located in the ports of the barrel wall, suitably the plug members and ports have cooperating wedging surfaces arranged to effect sealing. If required, the plug members may be composed of a combustible material.

The igniters may include primers and electronic igniters, such as bridge wire of semiconductor bridge devices.

Suitably the ports are located in the barrel wall adjacent to the expansion spaces provided rearwardly of said projectiles.

Preferably chambers housing the propellant charges are provided on the barrel adjacent to respective ports in the barrel wall.

The spacers may include rearwardly extending members or fins, suitably for aiding the stability of projectiles in flight. The spacer configuration may include apertures in the spacer body or spaced roots of said fins to allow communication of combustion products.

In a further broad aspect, the invention resides in an external initiation system for a barrel assembly having a plurality of projectiles axially stacked in end-to-end relation within a barrel wherein expansion spaces are provided rearwardly of projectile bodies; said initiation system including; a plurality of discrete propellant charges arranged externally of the barrel for propelling respective projectiles sequentially from the barrel; a series of igniters for initiating combustion of the discrete propellant charges; at least one port in the barrel wall for each propellant charge, said port allowing communication of combustion products into an associated expansion space.

LIST OF DRAWINGS

In order that this invention may be more readily understood and put into practical effect, reference will now be made to the accompanying drawings in which:

FIG. 1 is a side view of a prior art projectile;

FIG. 2 is a side view of a body part of the prior art projectile of FIG. 1;

FIG. 3 is a side view of the body part attached to a tail assembly;

FIG. 4 depicts an axial stack of the projectiles of FIG. 3;

FIGS. 5A and 5B are side and end views respectively of a tail assembly of a tail assembly;

FIGS. 6A and 6B are side and sectional end views respectively of a tail assembly;

FIG. 7 depicts a barrel assembly containing an axial stack of projectiles;

FIG. 7A is an enlarged view of an external initiation system of the barrel assembly of FIG. 7;

FIG. 8 is a side view of a projectile including a modified form of a tail assembly;

FIG. 9 depicts a barrel containing projectiles including a tail assembly;

FIG. 10 depicts a barrel fragment with a projectile including a modified form of the tail assembly;

FIG. 11 depicts a barrel fragment including details of an external propellant initiation arrangement with a modified port configuration;

FIG. 12 is an exploded, partially sectional view of a projectile with a tail assembly;

FIG. 13 is a partially sectional view of the projectile of FIG. 12;

FIG. 14 depicts a barrel assembly containing an axial stack of projectiles including the tail assembly; and FIG. 15 shows a modification of the projectile.

DESCRIPTION OF THE DRAWINGS

Referring to the drawings it will be appreciated that the invention can be implemented in various forms for a variety of purposes. This description is given by way of example only.

Figure 1:
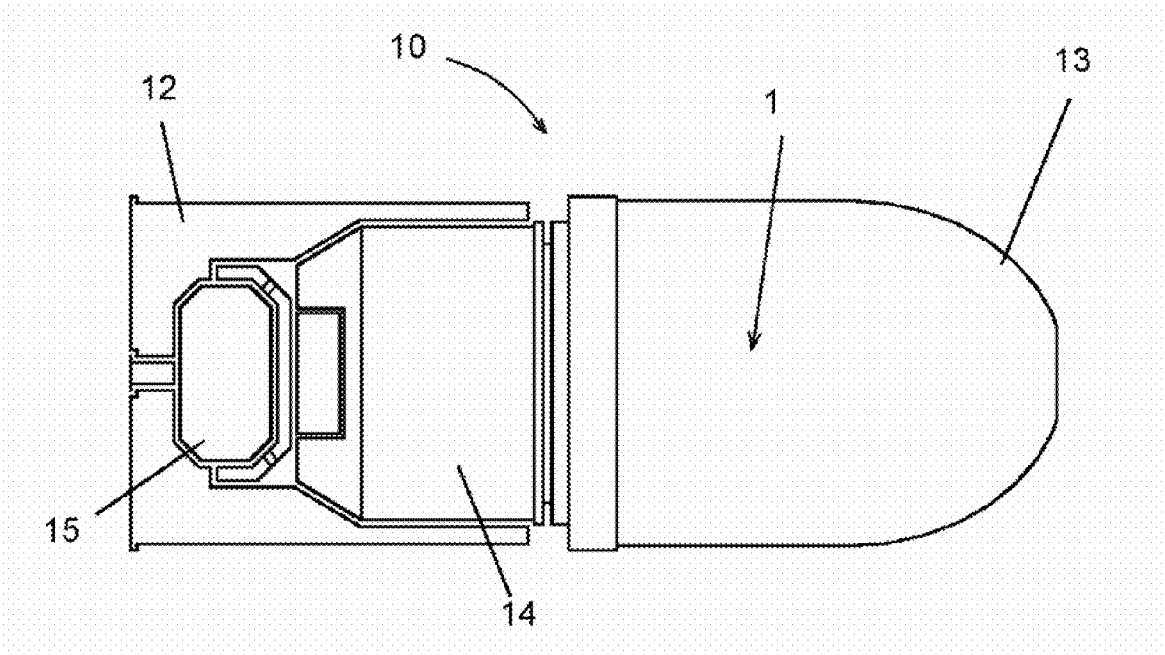
Fig. 1 (Prior Art)

The projectile 20 includes a body 21 having a rounded head portion 23 and a separate tail assembly 22 attached to, and extending rearwardly from, a rear portion 24 of the projectile body. The tail assembly 22 includes a spacer body 25 and sealing means, here in the form of a resilient obturation band 26, disposed in a groove or recess 27 provided in the outer circumferential portion or girth of the spacer body 25.

The tail assembly 22 has the primary function of providing an expansion space 29 (see FIG. 4) between adjacent projectiles 20 when stacked in axial end-to-end relation within a barrel. Opposite ends of the expansion space are, in this example, provided by the obturation bands 26 on the respective adjacent projectiles which bands are sealed to the internal surface of the barrel (not shown).

Figure 4:
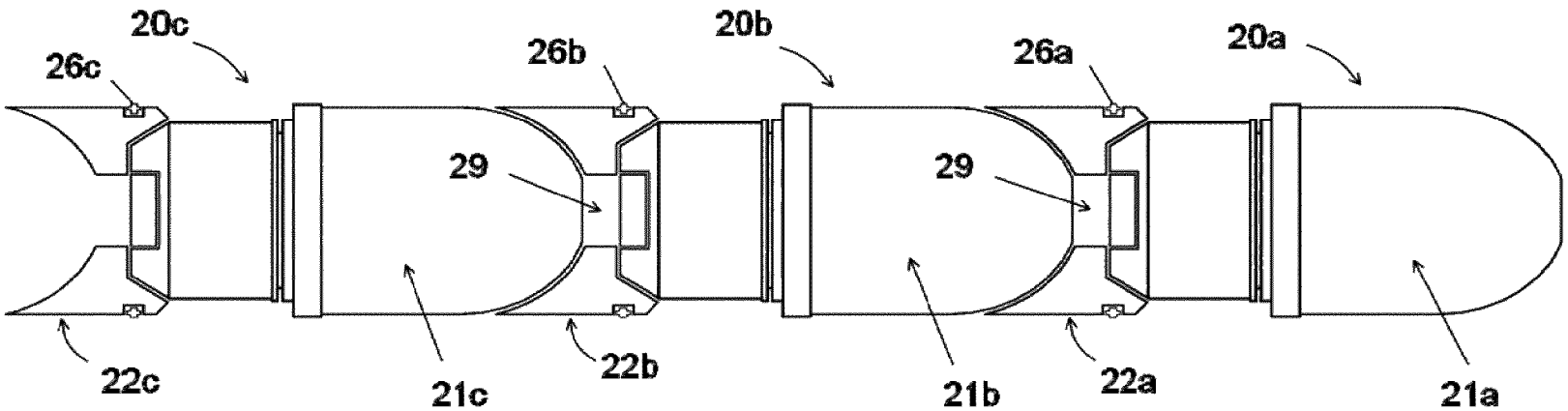

As is apparent from the stack of projectiles 20*a*, 20*b*, 20*c*, illustrated in FIG. 4, the tail assembly 22 is provided with a trailing surface 28 adapted to receive or at least abut the head portion 23 of an adjacent projectile body 21.

If desired, and for ease of loading a stack of projectiles into a barrel, the projectiles may be retained together in a chain by a frangible coupling. In one form the coupling may include a screw-threaded spigot projecting axially forward from the head portion 23 of the body of a projectile adapted for receipt in a socket provided in the rear portion 24 of an adjacent forward projectile body 21. The spigot is provided with a weakened area allowing separation upon firing of the forward projectile 20. Other frangible coupling arrangements may include soldering the spacer body 25 of a forward projectile 21*a* to the nose portion 23 of a following projectile 21*b*, which solder joint melts upon introduction of combustion products into the barrel.

Figure 6A:
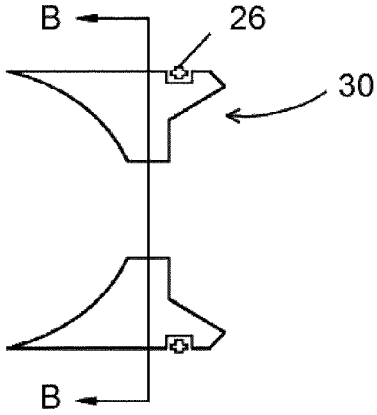
Figure 6B:
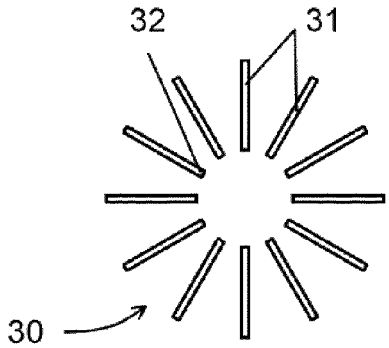

The spacer 25 may be formed as a body of rotation, or comprise a plurality of radially extending fins 31, as depicted in the alternative tail assembly 30 shown in FIGS. 6A and 6B. The roots or inner ends 32 of the fins are spaced apart to facilitate flow of combustion products into the expansion space 29.

Figure 5A:
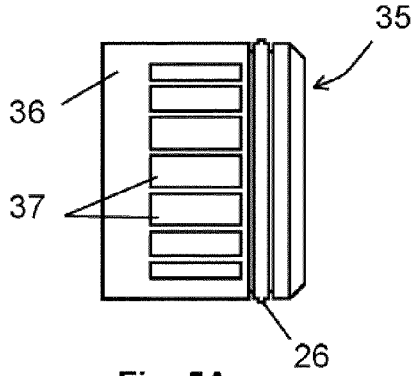
Figure 5B:
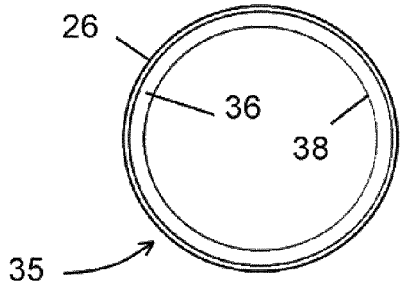

In another embodiment, as shown in FIGS. 5A and 5B, the tail assembly 35 includes a spacer body 36 that is of substantially cylindrical form. The internal surface 38 of the spacer body is arranged to abut an outer surface of the head portion 23 of an adjacent projectile body 21. The spacer body 36 includes a plurality of apertures 37 provided therein to provide fluid communication into the expansion space for propellant combustion products.

Figure 7:
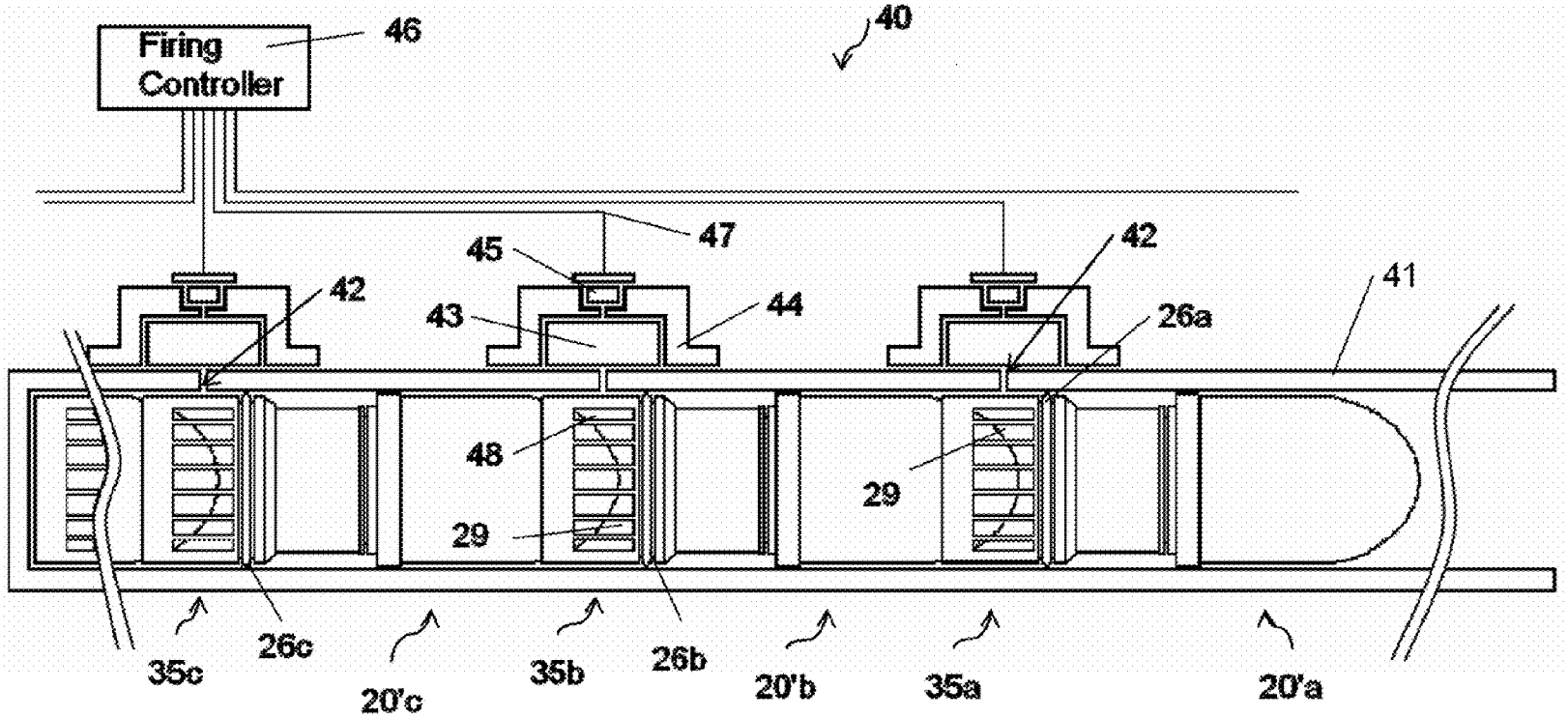

As mentioned briefly above, and shown in FIG. 7, a further aspect of this invention is concerned with a barrel assembly 40 having a plurality of projectiles 20'*a*, 20'*b*, 20'*c* stacked in end-to-end relation within a barrel 41. The projectiles 20' here include a tail assembly 35 substantially as described above in relation to FIGS. 5A and 5B. The tail assemblies from inter-projectile expansion spaces 29 behind respective projectiles.

The barrel 41 includes a plurality of ports 42 provided in the barrel wall, and discrete propellant charges 43 located in chambers 44 located externally of the barrel wall. The ports 42 are arranged, such that at least one port provides fluid communication between the inter-projectile expansion spaces 29 and respective propellant charges 43. Whilst only one port 42 per projectile expansion space 29 is depicted in the drawing, it will be appreciated that more than one port, perhaps arranged around the circumference of the barrel wall, may be employed as required.

The propellant charges 43 are initiated by igniters, here in the form of electrically activated primers 45 associated with the external chambers 44, in response to firing signals provided by a firing controller 46 via signal lines 47. For example, a firing signal supplied to a selected line 47 will activate a primer 45, which in turn ignites the associated propellant charge. The combustion products pass from the external chamber 44 into the expansion space 29 within the barrel 41 and propel a projectile 20' from the barrel 41.

Although the chambers 44 for propellant chambers are illustrated in the embodiment as laterally disposed with respect to the barrel 41, it will be appreciated that each chamber may be annular and extend around the circumference of the barrel. Alternatively, the annular chamber may include a number of sub-chambers, each sub-chamber having a respective igniter and associated port.

Figure 7A:
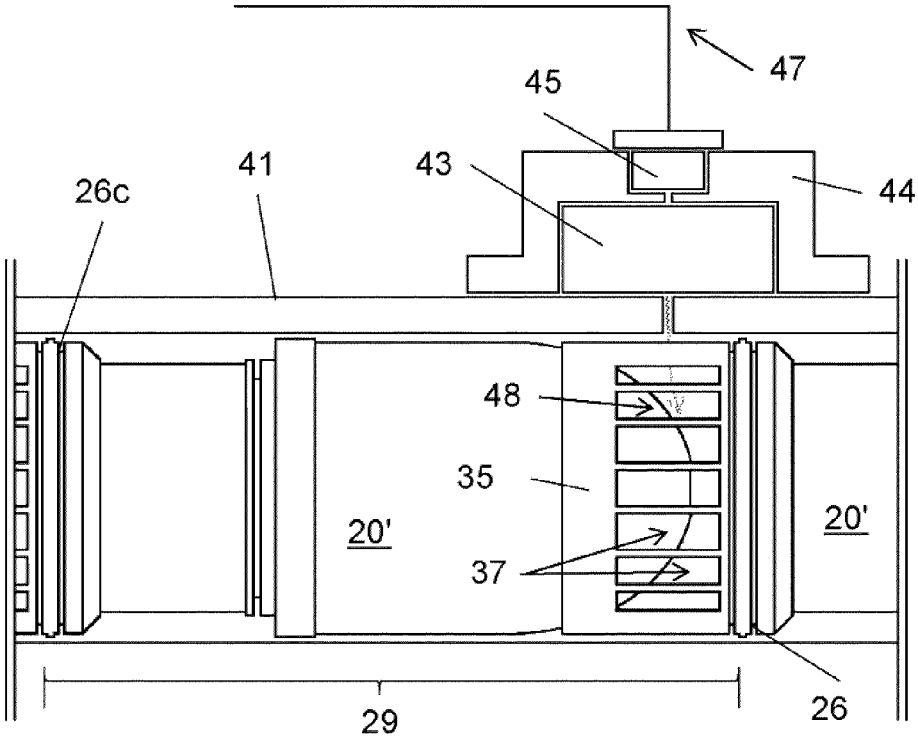

As depicted in the enlarged view in FIG. 7A, the apertures 37 in the spacer body 36 of the tail assembly 35 facilitate flow of the propellant combustion products 48 into the expansion space 29, the extent of which space may be notionally defined by the barrel wall 41 and the obturation rings 26*b*, 26*c* provided on respective projectiles 20'*b*, 20'*c*.

Figure 8:
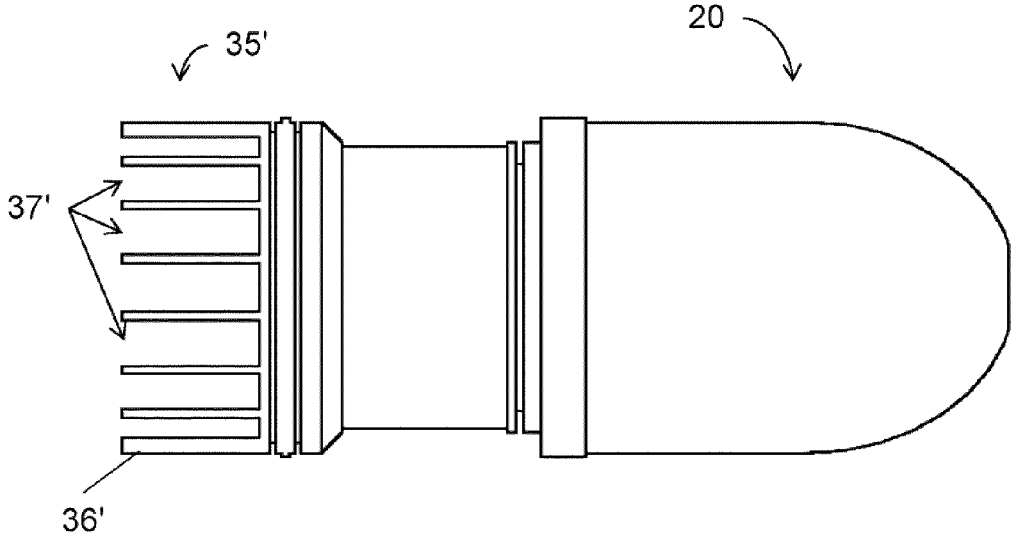

If required, a modified tail assembly 35' for the projectile could be manufactured, as depicted in FIG. 8, such that the apertures 37' extend through a rear portion of the cylindrical body 36'. It is considered that this open ended body 36' configuration may provide the projectile 20 with greater ballistic stability and reduced drag during flight.

In the barrel assembly 40 described above, the respective resilient obturation bands 26*a*, 26*b*, 26*c* reduce the likelihood of blow-by ignition between projectiles 20' by sealing respective projectiles to the internal surface of the barrel 41. However, there are a number of alternative sealing devices for projectiles that may be employed to form expansion spaces, as discussed below.

The tail assembly 52 of the projectile 50 depicted in FIG. 9 includes a lengthened spacer body 55 with an attachment means, in the form of radially inwardly extending rib 56 near a forward end of the body 55, which rib is arranged for engagement with a recess 57 found on the rear portion 54 of the projectile body 51. The rear end of the projectile body 51 includes a frustro-conical outer surface portion 53 which engages with a complementary frusto-conical inner surface portion 59 provided within the spacer body 55. The wedging action of the complementary surface portions 53, 59 expands a portion of the spacer radially outwardly to seal against the internal surface of the barrel 41.

In a minor variation, the attachment means of the following projectile 50' includes an internal circumferential recess 56' provided near a forward end of the spacer body 55', which recess is engaged by an outwardly extending rib 57' found on the rear portion 54' of the projectile body 51'. The operation of the wedging action is substantially unchanged from that of projectile 50.

Turning to projectile 50" depicted in FIG. 10, a further modification of the tail assembly 52" includes a spacer body 55" with an attachment means having both an inwardly extending rib and an internal circumferential recess for more positive engagement with complementary structures on the rear portion 54 of the projectile body 51. Furthermore the spacer body 55" may extend over the projectile body 51 forwardly of the rear portion 54 thereof, whereby the modified spacer body allows projectiles of a smaller calibre to be used with a barrel assembly of a somewhat larger calibre. For example, a 37 mm projectile attached to a suitably dimensioned tail assembly 52" may be used with a 40 mm barrel assembly.

An alternative way of reducing the chance of blow-by ignition of other propellant charges, is to seal the ports 42 in the wall of the barrel using sealing means in the form of plug members 49 located in the ports of the barrel wall. In the embodiment illustrated in FIG. 11, the plug members 49 and ports 42' have cooperating wedging surfaces arranged to effect sealing, whereby pressure from the barrel interior reinforces the seal and (conversely) pressure from burning propellant contained in the chamber 44 releases the plug 49 from the port 42'. If desired, the plug members may be composed of combustible material or include a retaining means to prevent expulsion of the plug from its port.

Figure 2:
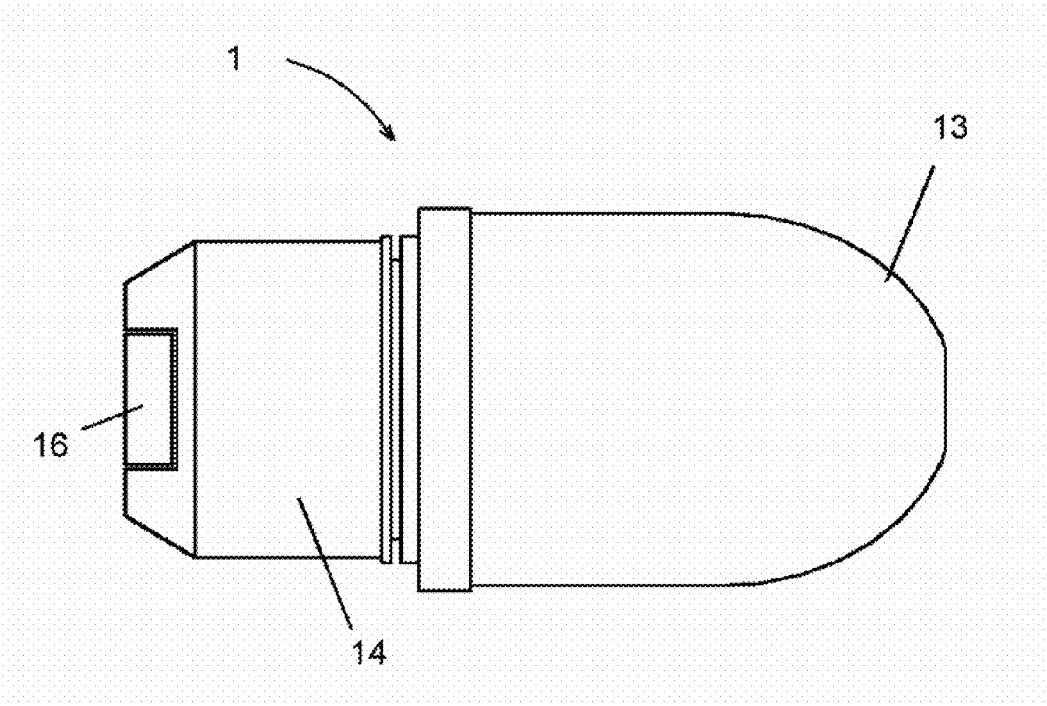
Fig. 2 (Prior Art)
Figure 3:
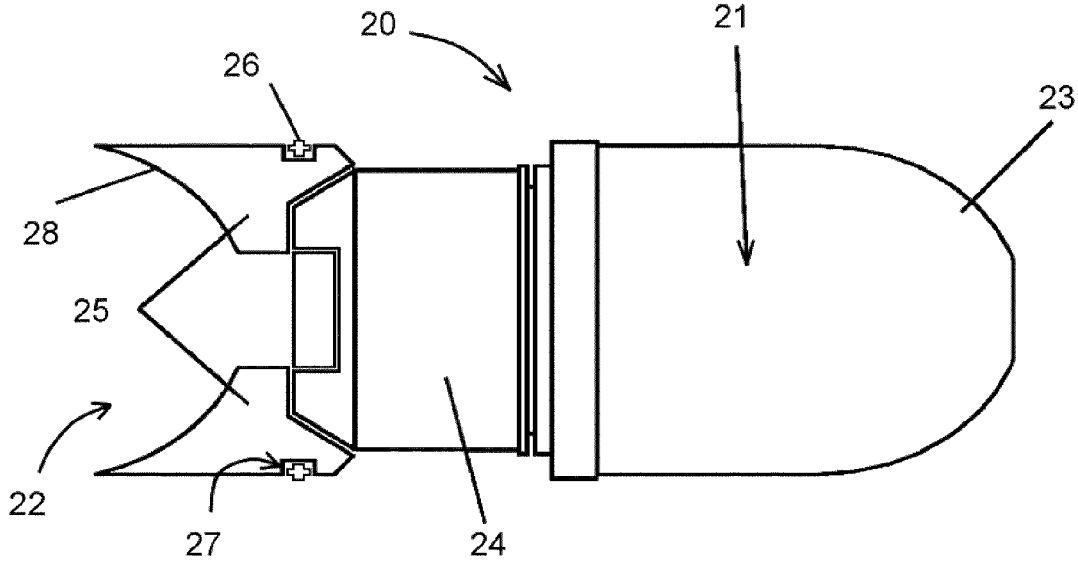
In FIG. 3 there is shown a side elevational view of a projectile that has been modified by provision of a tail assembly. The tail assembly modifies the projectiles for use with a barrel having propellant charges disposed externally of the barrel and, when ignited, combustion products from the burning propellant are admitted into the barrel by a port or ports in the barrel wall to propel the projectile. The barrel assembly will be described further below in relation to FIG. 7.
Figure 12:
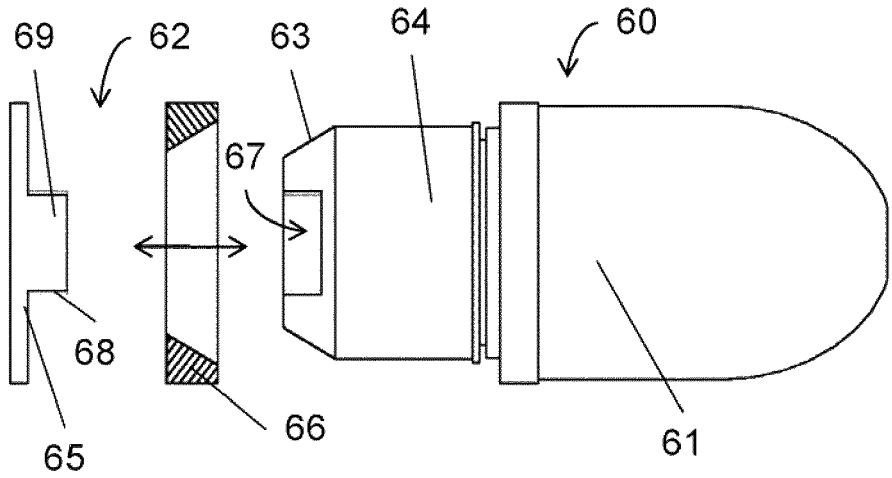

The projectile 60 depicted in exploded form in FIG. 12 includes a tail assembly 62 having a spacer body 65 which acts as a retainer for a sealing ring 66 having a tapered inner surface. It will be appreciated that the projectile body 61 is similar in configuration to that described in relation to FIG. 2, in that a rear portion 64 thereof includes a recess 67 having an internal screw-thread. The rear portion 64 also has a tapered outer surface portion 63 complementary to the inner surface of the sealing ring 66. A mating screw thread 68 is provided on a spigot portion 69 of the spacer body 65.

Figure 13:
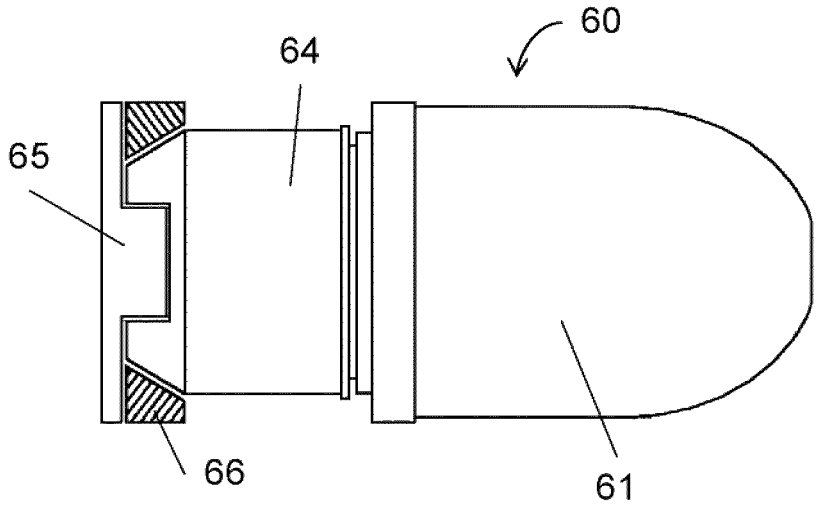

During assembly, the sealing ring 66 is disposed over the tapered surface portion 63 of the end 64 of the projectile body 61, as depicted in FIG. 13. The spacer body 65 is then attached to the projectile body by engaging the respective screw-threads of the spigot portion 69 and the recess 67. The components of the tail assembly 62 are arranged such that some axial travel of the sealing ring 66 is possible relative to the rear portion 64 of the projectile body 61.

Figure 14:
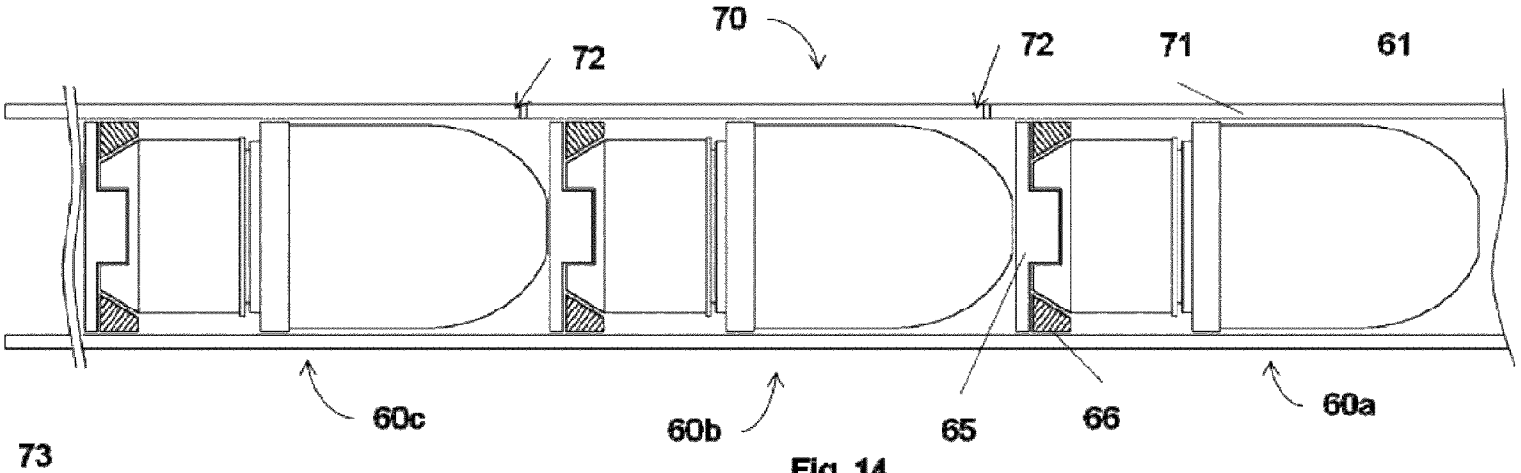

Turning to the barrel assembly 70 depicted in FIG. 14, it is to be noted that cavities for external propellant charges associated with the ports 72 shown in the wall of the barrel 71 have been omitted from this drawing. A stack of projectiles 60*a*, 60*b*, 60*c* are loaded individually into the barrel from its rear or breach end 73 with the aid of a stopper member (not shown) inserted into the forward or muzzle end of the barrel. The stopper member positions the leading or front-most projectile 60*a* of the stack longitudinally within the barrel 71, and relative to an associated port 72.

Most preferably, the component pieces of individual projectiles 60 are assembled as they are loaded into the breech 73 of the barrel 71. First the projectile body 61 is inserted followed by the sealing ring 66, which ring is located over the tapered face 63 of the rear portion 64 of the body. The sealing ring 66 is then forced toward the projectile body 61 so that the ring moves over the tapered face 63 and is wedged into sealing engagement with the bore of the barrel 71. Subsequently, the spacer body is inserted into the barrel and screwed into the recess 67 at the rear of the projectile body 61.

This in-barrel assembly process is then repeated for the remaining projectiles 60*b*, 60*c*, etc. forming the stack. The stopper member may then be withdrawn from the muzzle of the barrel 71. The arrangement is such that, when (for example) combustion products are released into the barrel through a port, the gas pressure on the rear face of the spacer member 65 moves the spacer and projectile body 61 forward relative to the sealing ring 66 which is released from the bore of the barrel 71.

Figure 15:
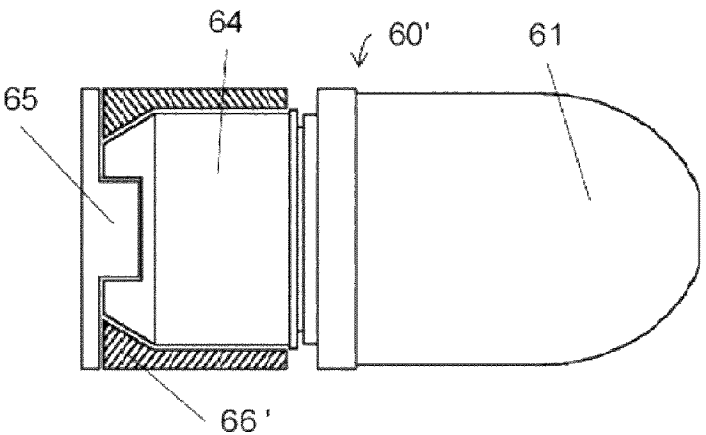

It should be appreciated that the spacer member 65 may include a longer body with rearwardly extending skirt members or fins, as described in relation to FIGS. 5 and 6. Similarly, the sealing ring 66' may extend further forward along the rear portion 64 of the projectile body 61 as depicted in FIG. 15.

It is to be understood that the above embodiments have been provided only by way of exemplification of this invention, and that further modifications and improvements thereto, as would be apparent to persons skilled in the relevant art, are deemed to fall within the broad scope and ambit of the present invention described herein.

The invention claimed is:

1. A stackable projectile for a barrel of a stacked projectile weapon, the stackable projectile comprising:

a projectile body portion having a rear portion, the rear portion of the projectile body portion including a screw thread;

a tail assembly including (i) a forward portion, the forward portion including a mating screw thread for engaging the screw thread of the rear portion of the projectile body, and (ii) a surface for abutment by a nose portion of an adjacent trailing projectile when stacked in a barrel of a stackable projectile weapon; and a ring for engaging against the barrel of the stackable projectile weapon when loaded therein, said ring including an inner surface for engaging a tapered outer surface of the projectile for expanding the ring radially outward in response to screwing of the mating screw thread and the screw thread of the rear portion.

2. A projectile according to claim 1, wherein the tail assembly includes a lengthened body extending over the projectile body forwardly of the rear portion of the projectile body.

3. A projectile according to claim 2, wherein the ring is formed with a lengthened body.

4. A projectile according to claim 1, wherein the inner surface of the ring is tapered.

5. A projectile according to claim 1, wherein the ring is a sealing ring and sealingly engages against the barrel of the stackable projectile weapon when loaded therein.

6. A projectile according to claim 1, wherein the screw thread of the rear portion is an internal screw thread and the mating screw thread of the forward portion is formed on a spigot.

7. A projectile according to claim 1, wherein the tapered outer surface of the projectile is formed on the projectile body portion.

8. A projectile according to claim 1, wherein the tail assembly provides an expansion space rearwardly of the projectile body for propellant gasses for propelling the projectile.

9. A projectile according to claim 1, wherein the tail assembly is configured to form a frangible coupling with a nose portion of an adjacent trailing projectile.

10. A projectile according to claim 1, wherein a nose portion of the projectile body portion is rounded and the tail assembly is configured to receive a nose portion of an adjacent trailing projectile.

11. A projectile according to claim 1, wherein the ring is a separate band.

* * * * *